US006644776B1

(12) United States Patent
Barinaga et al.

(10) Patent No.: US 6,644,776 B1
(45) Date of Patent: Nov. 11, 2003

(54) SNOUT WIPER ASSEMBLY

(75) Inventors: John A. Barinaga, Portland, OR (US); Jeffrey J. Anderson, Vancouver, WA (US); Antonio Gomez, Vancouver, WA (US); Russell P. Yearout, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/202,208

(22) Filed: Jul. 22, 2002

(51) Int. Cl.[7] ..... B41J 2/165
(52) U.S. Cl. ..... 347/33
(58) Field of Search ..... 347/33, 35, 36; 15/97.1, 236.01, 245, 256.5; 399/345, 350, 351, 359

(56) References Cited

U.S. PATENT DOCUMENTS

| | | | | | |
|---|---|---|---|---|---|
| 5,555,461 | A | * | 9/1996 | Ackerman | 347/33 |
| 5,774,139 | A | | 6/1998 | Salzer et al. | 347/32 |
| 6,102,518 | A | * | 8/2000 | Taylor | 347/29 |
| 6,151,044 | A | | 11/2000 | Gaasch | 347/33 |
| 6,155,667 | A | | 12/2000 | Eckard et al. | 347/33 |
| 6,224,186 | B1 | | 5/2001 | Johnson et al. | 347/28 |
| 6,238,112 | B1 | | 5/2001 | Girones et al. | 400/74 |
| 6,244,683 | B1 | | 6/2001 | Alvarez et al. | 347/22 |
| 6,247,783 | B1 | | 6/2001 | Shibata et al. | 347/35 |
| 6,273,547 | B1 | * | 8/2001 | Aldrich | 347/36 |
| 6,318,837 | B1 | * | 11/2001 | Barinaga | 347/33 |
| 6,340,220 | B1 | | 1/2002 | Gaylor et al. | 347/35 |
| 6,398,340 | B1 | * | 6/2002 | Lin | 347/33 |
| 6,416,161 | B1 | * | 7/2002 | Berg et al. | 347/33 |

OTHER PUBLICATIONS

Patent application Ser. No. 08/961,050, filed Aug. 24, 2000, "Electrical Interconnect Cleaning System for Inkjet Cartridges," HP#10970788–1, now abandoned.

Patent application Ser. No. 09/560,430, filed Apr. 28, 2000, "Electrical Interconnect Cleaning System for Inkjet Cartridges," HP#10970788–3.

Patent application Ser. No. 09/773,873, filed Jan. 31, 2001, "Ink Drop Detector Waste Ink Removal System," HP#10007785–1.

Patent application Ser. No. 09/773,881, filed Jan. 31, 2001, "Uni–Directional Waste Ink Removal System," HP#10007716–1.

Patent application Ser. No. 10/015,818, filed Oct. 30, 2001, "Curved Wiper Blade System for Inkjet Printheads," HP#10004151.

* cited by examiner

*Primary Examiner*—Stephen D. Meier
*Assistant Examiner*—Blaise Mouttet

(57) ABSTRACT

A snout wiper assembly includes a support member, a supported member and a snout wiper. The support member defines a travel slot. The supported member is movable along the travel slot between positions including a wiping position and a resting position. The snout wiper is carried by the supported member.

21 Claims, 8 Drawing Sheets

SNOUT WIPER ASSEMBLY

BACKGROUND

An inkjet printing mechanism, such as a printer, a facsimile machine, plotter, copier, photo-printer, postal franking machine, fabric printer, etc., may contain one or more pens, such as one black and three color pens. Each pen contains an orifice plate defining a plurality of ink-ejecting nozzles. During operation, ink discharged from the nozzles may form a residue that adheres to the orifice plate, which may build up over time.

Inkjet mechanism wiping systems are used in cleaning the orifice plate. A cleaning process by which residue is removed from the orifice plate involves an orifice plate wiper, which dislodges and removes the residue. This wiping process can transfer some of the residue to the snout surface of the pen, which is typically perpendicular to the orifice plate.

Referring to FIG. 1A, an orifice plate 100 of a pen 102 is covered with residue 104. A nozzle wiper 106 having first and second blades 108, 110 is used to remove the residue from the orifice plate. A globule 112 of residue may be present on one or both of the blades, due to prior contact between the blades and the orifice plate.

As seen in FIG. 1B, contact between the wiper blades and the pen may cause formation of a deposit 114 of residue on the snout surface 116 of the pen 102. New globules 118 of residue form on the blades of the wiper, as they moved relative to the pen.

As seen in FIG. 1C, the residue carried by the orifice plate is removed by the wiper 106. However, the new globules 118 of residue that have formed on the blades of the wiper may be added to the deposit 114 of residue which has formed on the snout surface 116 of the pen 102 when the orifice place 100 is cleaned at a later time.

If residue is allowed to build up on the snout surface, contact between the residue—or fibers carried by the residue—and print media may result in print defects. As seen in FIG. 1D, a fiber 120 has become attached to the deposit 114 of residue on the snout surface 116. The fiber may be cellulose or similar material derived from paper media, lint, hair or other elongated material. During a printing operation, the fiber 120 may come into contact with the paper media 122, resulting in a condition known as "fiber tracking." Fiber tracking is reminiscent of the action taken by a paint brush, wherein ink recently deposited is smeared on the print media. Where the deposit 114 grows sufficiently in size, the deposit itself may contact or fall onto the print media, thereby applying unwanted ink to the media, and moving ink already deposited on the media. Where ink residue comes into contact with electrical connections associated with the inkjet printing mechanism, "ink shorts" may result, due to the electrical conductivity of the ink.

SUMMARY

A snout wiper assembly includes a support member, a supported member and a snout wiper. The support member defines a travel slot. The supported member is movable along the travel slot between a wiping position and a resting position. The snout wiper is carried by the supported member.

BRIEF DESCRIPTION OF THE DRAWINGS

The same numbers are used throughout the drawings to reference like features and components.

DETAILED DESCRIPTION

Figure 1A:
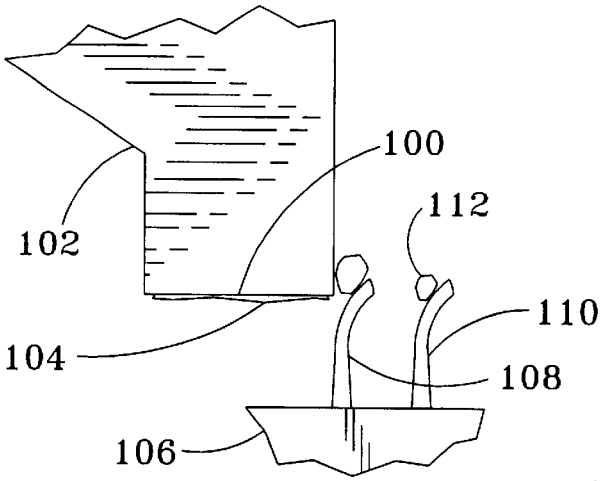
FIG. 1 includes four side elevation views illustrating an inkjet pen cleaning process during which some ink residue carried by an orifice plate of a pen is inadvertently transferred to a snout surface of the pen.
Figure 1B:
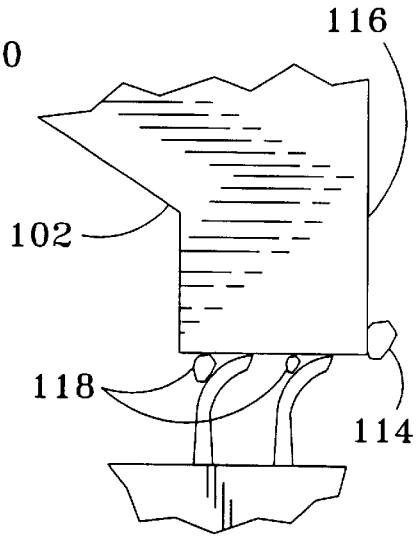
Figure 1C:
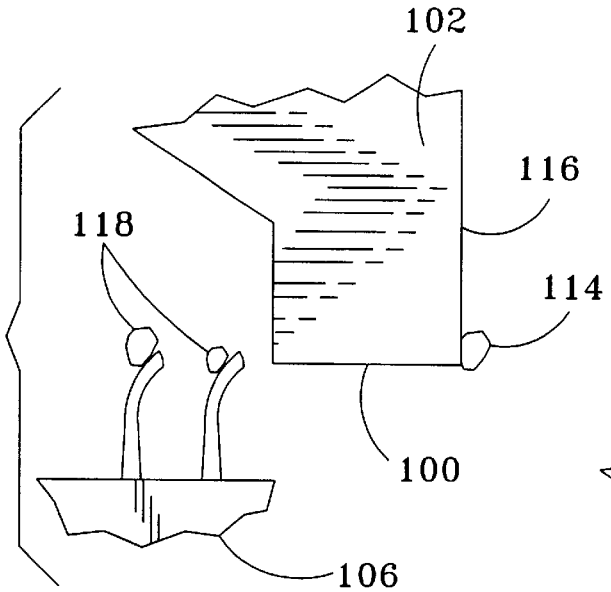
Figure 1D:
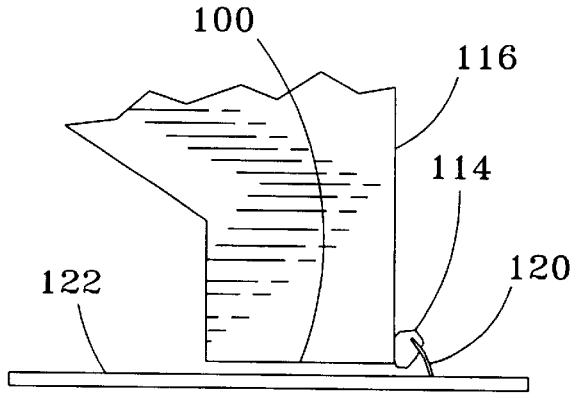
Figure 2:
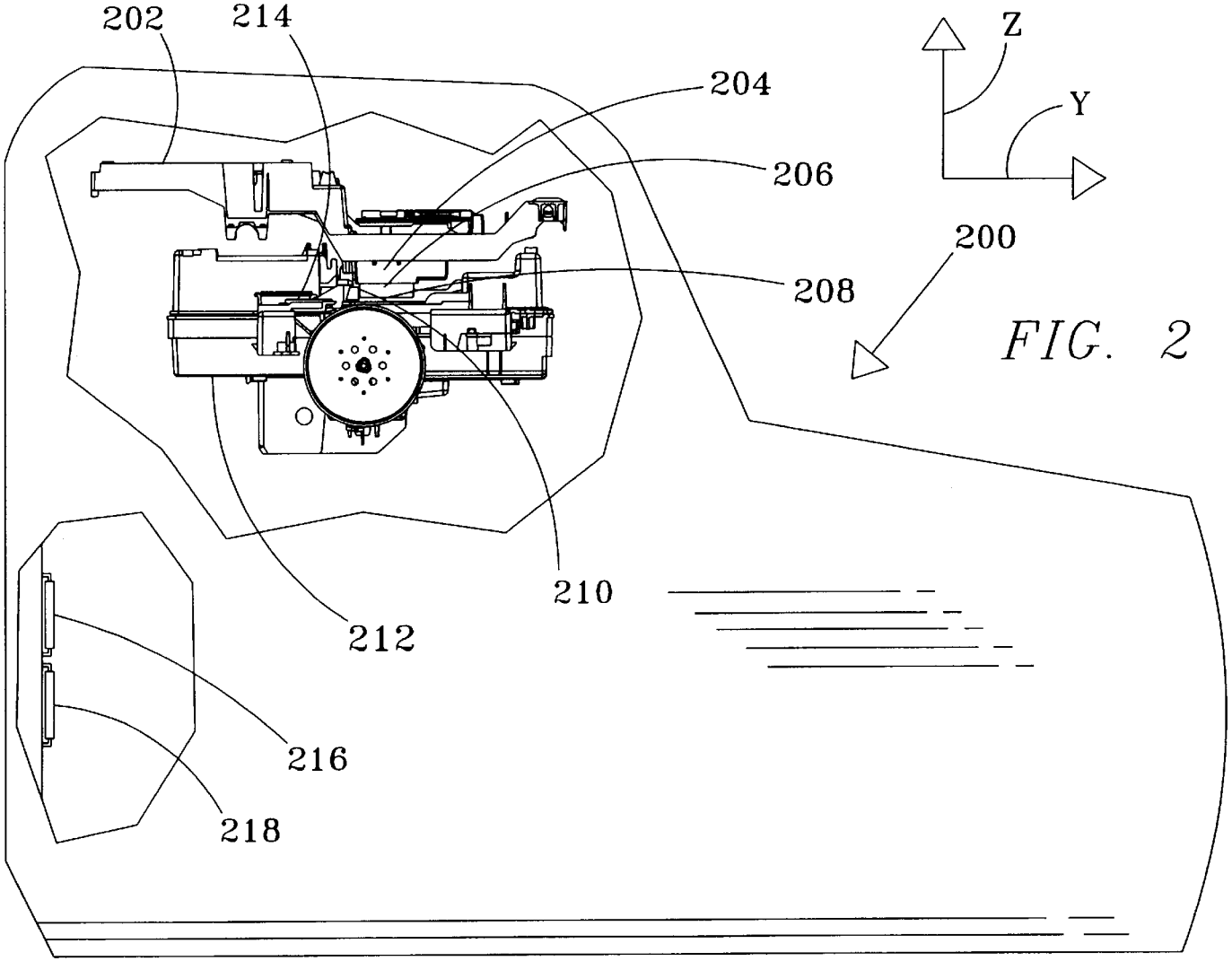
FIG. 2 is a side elevation view of an inkjet printing mechanism, illustrated for purposes of example as an inkjet printer. A first cut-away section illustrates an embodiment of a service station having a snout wiper assembly, and a second cut-away illustrates a circuit board having a processor and a memory device containing firmware which contains processor-executable steps which implement a method of operating the snout wiper assembly.

FIG. 2 shows an implementation of an inkjet printing mechanism 200, illustrated for purposes of example as an inkjet printer, but which could alternatively be a facsimile machine, plotter, photo imager or other mechanism having an inkjet printing mechanism. Within an upper cutaway, a carriage 202 carrying an inkjet printing mechanism 204 is illustrated. The orientation of the illustration of the inkjet printing mechanism shows a single black pen 206 having a nozzle orifice plate 208 that is downwardly directed. A snout surface 210 is adjacent to the nozzle orifice plate 208, and is oriented perpendicularly to the nozzle orifice plate 208.

Continuing to refer to the upper cutaway of FIG. 2, the carriage 202 is parked adjacent to a service station 212, which allows the performance of maintenance functions. Such functions include "spitting," which clears nozzles defined within the orifice plate by ejecting ink, and cleaning, during which the nozzle orifice plate 208 and the snout surface 210 are wiped, thereby removing ink residue which may build up during the printing process. In particular, a snout wiper assembly 214 is provided to remove ink residue from the snout surface 210 of each pen (black and color).

Referring to a lower cutaway shown in FIG. 2, a processor 216 and a ROM (read only memory) 218 are seen. During operation, the processor executes processor-executable instructions contained in the ROM, or similar memory device, such as a disk drive or a RAM (random access memory) device. Execution of the processor-executable instructions controls the snout wiper assembly 214 of the inkjet printing mechanism, allowing better maintenance of the inkjet printing mechanism, thereby producing better-looking and higher quality printed media.

Figure 3:
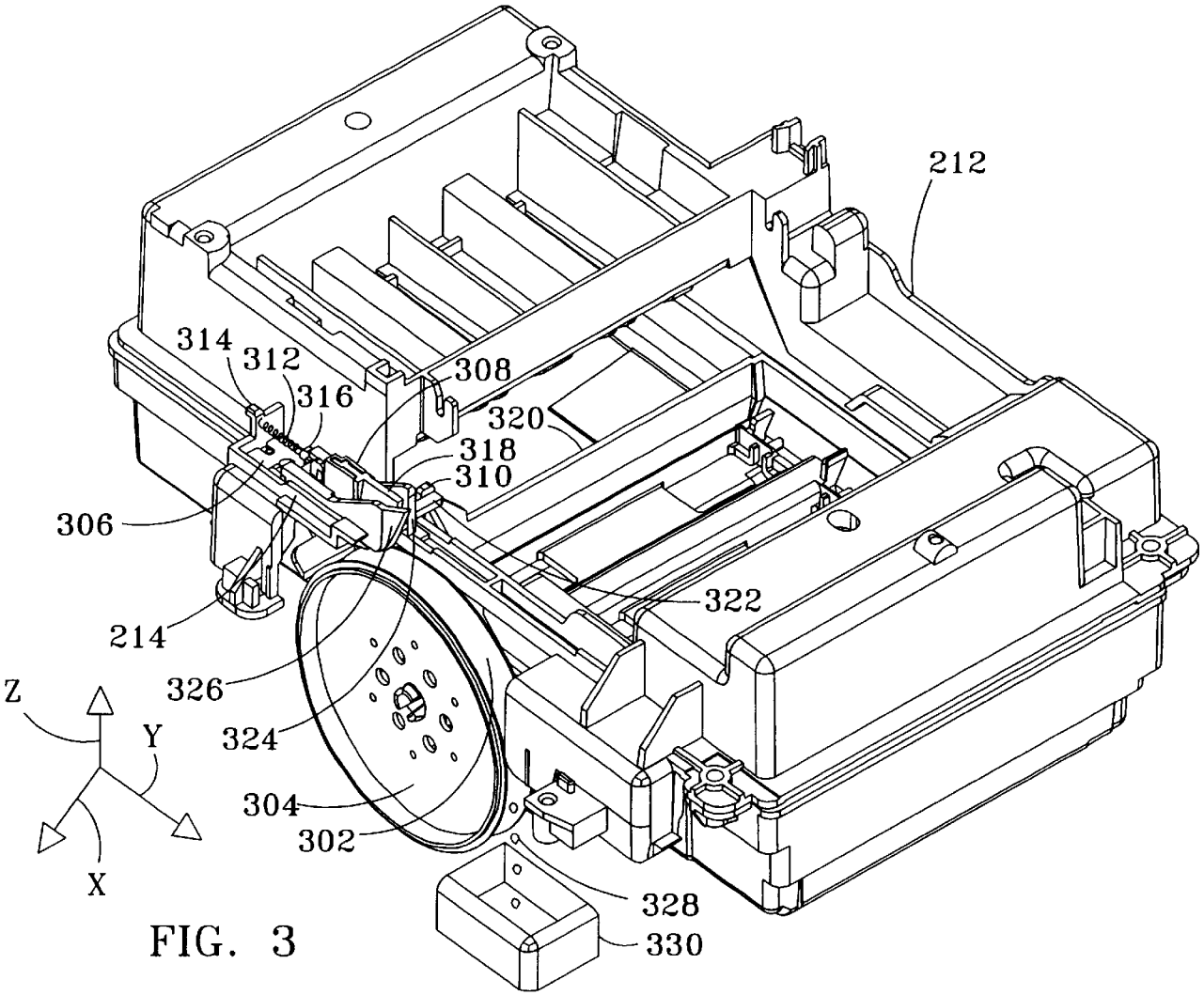
FIG. 3 is an enlarged perspective view of the implementation of the service station and the snout wiper assembly of FIG. 2, wherein the snout wiper portion of the snout wiper assembly is in a resting position.

FIG. 3 shows an enlarged perspective view of the service station 212, which provides cleaning and maintenance functions on the printing mechanism (not shown). Cleaning functions include wiping the nozzle orifice plate of each pen to remove ink residue. The orifice surface wiping function is performed by an inkjet nozzle wiper, similar to wiper 106 of FIG. 1, which is associated with each pen. The wipers are carried by a pallet, which is carried by the service station. The wiping process results in some build-up of ink residue on the snout surface 210, as seen in FIG. 1.

Maintenance includes allowing the pens to "spit," or discharge ink through their nozzles, which clears ink that has partially dried or degraded. A perimeter surface 302 of a waste removal member, such as spit wheel 304, receives ink discharged in this manner from each pen. As will be seen in greater detail below, revolution of the spit wheel transports waste ink and ink residue for disposal.

The snout wiper assembly 214 is supported by the service station 212, and removes ink residue and build-up on the snout surface 210. The snout wiper assembly 214 includes a support member, such as shuttle base 306, a supported member, such as shuttle 308 and a snout wiper 310. The shuttle base 306 is attached to, or integrally formed with, the service station 212. The shuttle base 306 defines a travel path, within which the shuttle 308 moves between an extended, wiping position, and a retracted, resting position. In operation, when the shuttle 308 is in the extended position, the snout wiper 310 makes contact with the snout surface 210 of a pen. As the pen is moved against the snout wiper 310, ink residue is removed from the snout surface 210.

A spring 312, or other biasing member, urges the shuttle 308 into the resting, or retracted, position. A first end of the spring 312 is attached to a hook 314 on the service station, while a second end of the spring 312 is attached to a hook 316 carried on the shuttle. The snout wiper assembly 214 is moved into the extended position by an activating member, such as a post 318 carried by a pallet portion 320 of the service station. The post engages the arm 322 of the shuttle 308, thereby overcoming the bias of the spring 312, extending the shuttle 308 into the wiping position. When the post 318 reverses its course, the arm 322 is released to allow travel, and the spring 312 retracts the shuttle 308 into the resting position.

Inner and outer blade cleaning members 324, 326 are supported by the shuttle base 306 in a location above the spit wheel 304. As will be seen in greater detail in the discussion of FIGS. 6 and 7, the inner and outer blade cleaning members 324, 326 remove ink residue from the snout wiper 310. Positioned on either side of the snout wiper 310, the blade cleaning arms remove ink residue as the snout wiper 310 is retracted from the wiping position to the resting position. Ink residue removed in this manner drops onto the perimeter 302 of the spit wheel 304. Revolution of the spit wheel 304 transports the waste ink residue 328 to a waste container 330.

Figure 4:
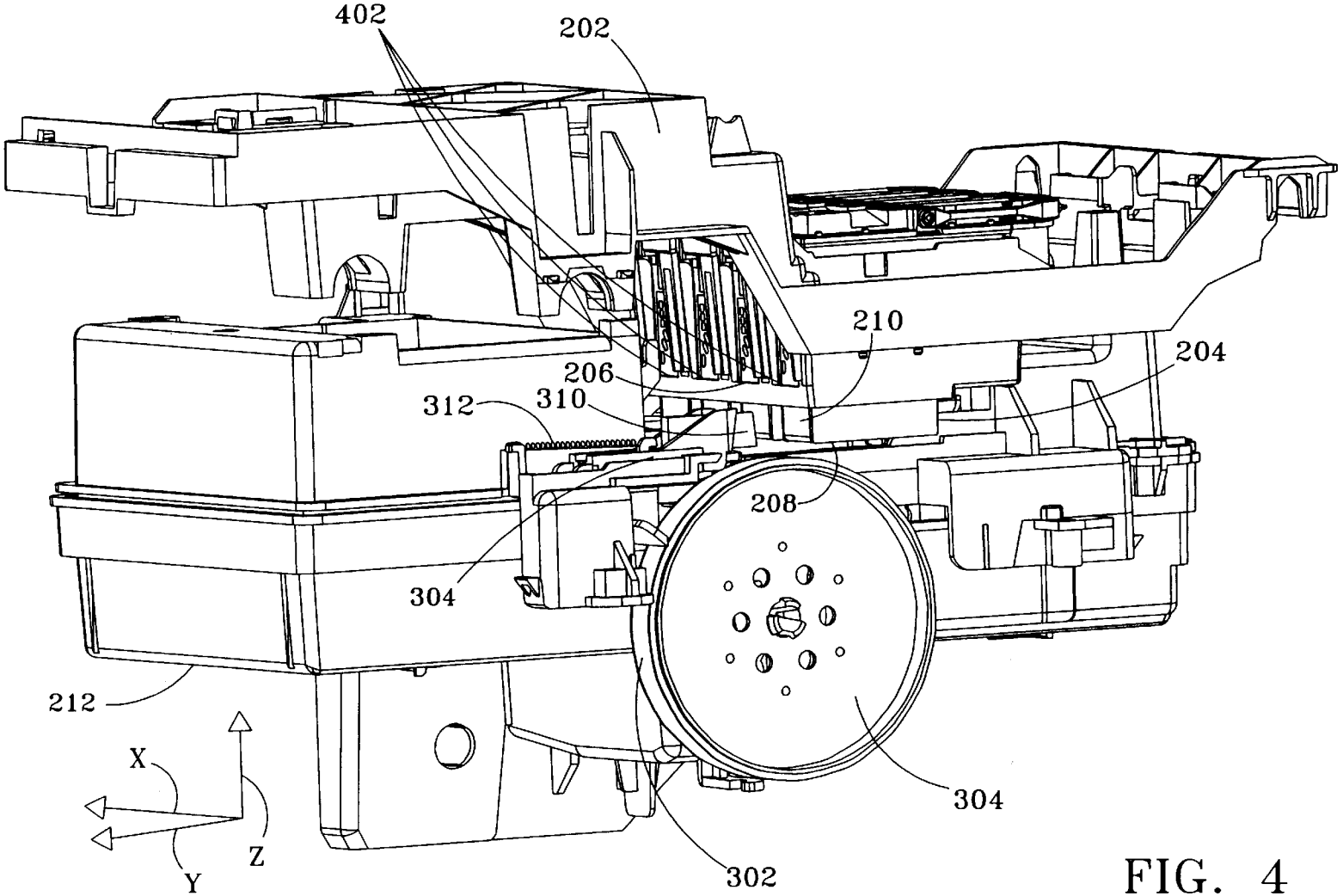
FIG. 4 is an enlarged perspective view showing an implementation of a carriage supporting a printing mechanism having four pens, which is adjacent to the service station of FIG. 3. The snout wiper is shown in an extended position, having just wiped a snout portion of a black pen.

FIG. 4 shows an enlarged view of the carriage 202 supporting the printing mechanism 204 adjacent to the service station 212. The implementation of FIG. 4 includes a black pen 206 and three color pens 402 (such as cyan, magenta and yellow). Each pen includes an orifice plate 208, which defines a plurality of nozzles which dispense ink during operation.

In the implementation of FIG. 4, the snout wiper 310 is illustrated wiping the snout surface 210 of the black pen 206. The snout surface 210 of each pen is adjacent to the orifice plate 208 of the same pen, and is oriented approximately 90 degrees with respect to that orifice plate. The wiping activity results from movement of the printing mechanism 204 after the shuttle 308 has been extended into the wiping position against the bias of the spring 312, thereby putting the snout wiper 310 into contact with the snout surface 210 of a pen. The wiping activity removes ink residue which may have accumulated on the snout surface 210, causing the ink residue to adhere to the snout wiper 310. As will be seen in greater detail in FIGS. 6 and 7, ink residue is removed from the snout wiper 310 as the shuttle 308 is retracted into the resting position within the shuttle base 304, and the snout wiper 310 is cleaned by the blade cleaning members 324, 326. Ink residue removed by the blade cleaning members is transferred to the perimeter surface 302 of the spit wheel 304 for removal.

Figure 5:
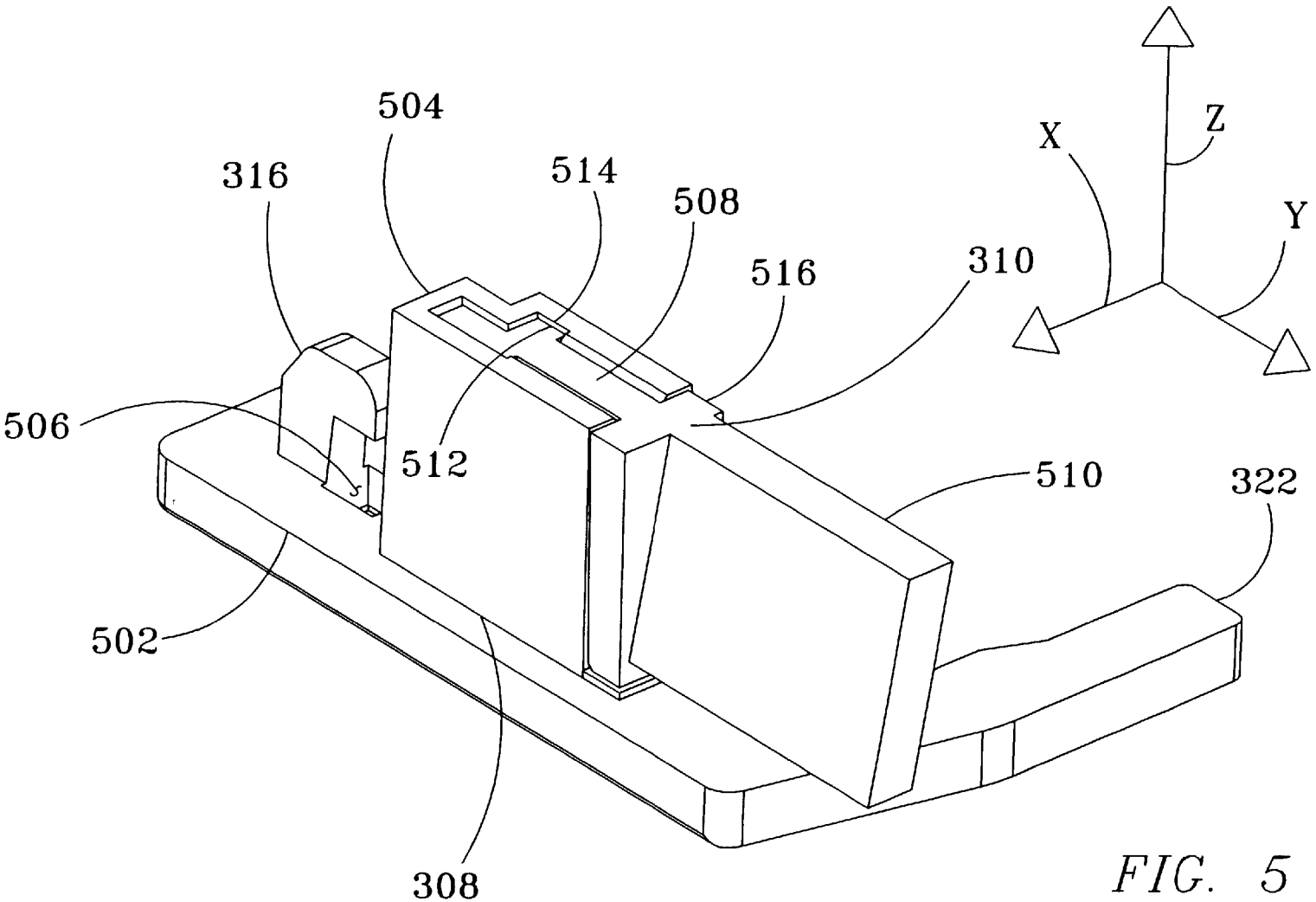
FIG. 5 is an enlarged perspective view of the shuttle and snout wiper portions of the snout wiper assembly, with the shuttle base removed to reveal details of the illustrated components.

FIG. 5 shows an enlarged view of the structure of the shuttle 308 and snout wiper 310 of the snout wiper assembly 214. FIG. 5 does not illustrate the shuttle base 304, seen in FIG. 4, and therefore better illustrates some features of the shuttle 308 and snout wiper 310.

In particular, the shuttle 308 includes a base 502, which carries a socket 504 and the hook 316. A hole 506 defined in the base 502 between the hook 316 and the socket 504 is associated with the manufacture of the shuttle 308. An arm 322 extending from the base 502 of the shuttle 308 allows the shuttle 308 to be moved within a travel slot defined between the rails of the base 502, against the bias of the spring 312 attached to the hook 316.

The snout wiper 310 includes a base 508, which is carried by the shuttle 308, and a blade 510, which wipes the snout surface 210 of a pen. The base 508 is sized for insertion into a cavity defined by the socket 504 carried by the shuttle 308. A key 512 in the snout wiper's base 508 corresponds to a similar key 514 defined in the socket 504 of the shuttle 308. The key 512 prevents the base 508 from being inserted into the socket 504 unless it is correctly oriented. A shoulder 516 seats the snout wiper 310 against the socket 504 of the shuttle 308. By correctly orienting the snout wiper 310, the angle of the blade 510, as illustrated in FIG. 5, can be assured. As will be seen below, the angle of the blade 510 depends on the geometry of the installation, but should result in the transfer of ink residue onto the perimeter of the spit wheel 304 or other waste removal mechanism. As seen in FIG. 5, the angle of the blade 510 may be an acute angle with respect to the Z-axis.

In a first implementation, the blade 510 is made of rubber, plastic or similar material. In an alternate implementation, the blade 510 may be made of an absorbent material, such as needle felt. The needle felt may be made of polyester fibers, polypropylene fibers, nylon or similar material. In this implementation, ink residue is removed from the snout by physical contact between the blade 510 and the snout surface 210, at times assisted by capillary attraction or similar forces which result from the absorptive nature of the felt or similar material.

Figure 6:
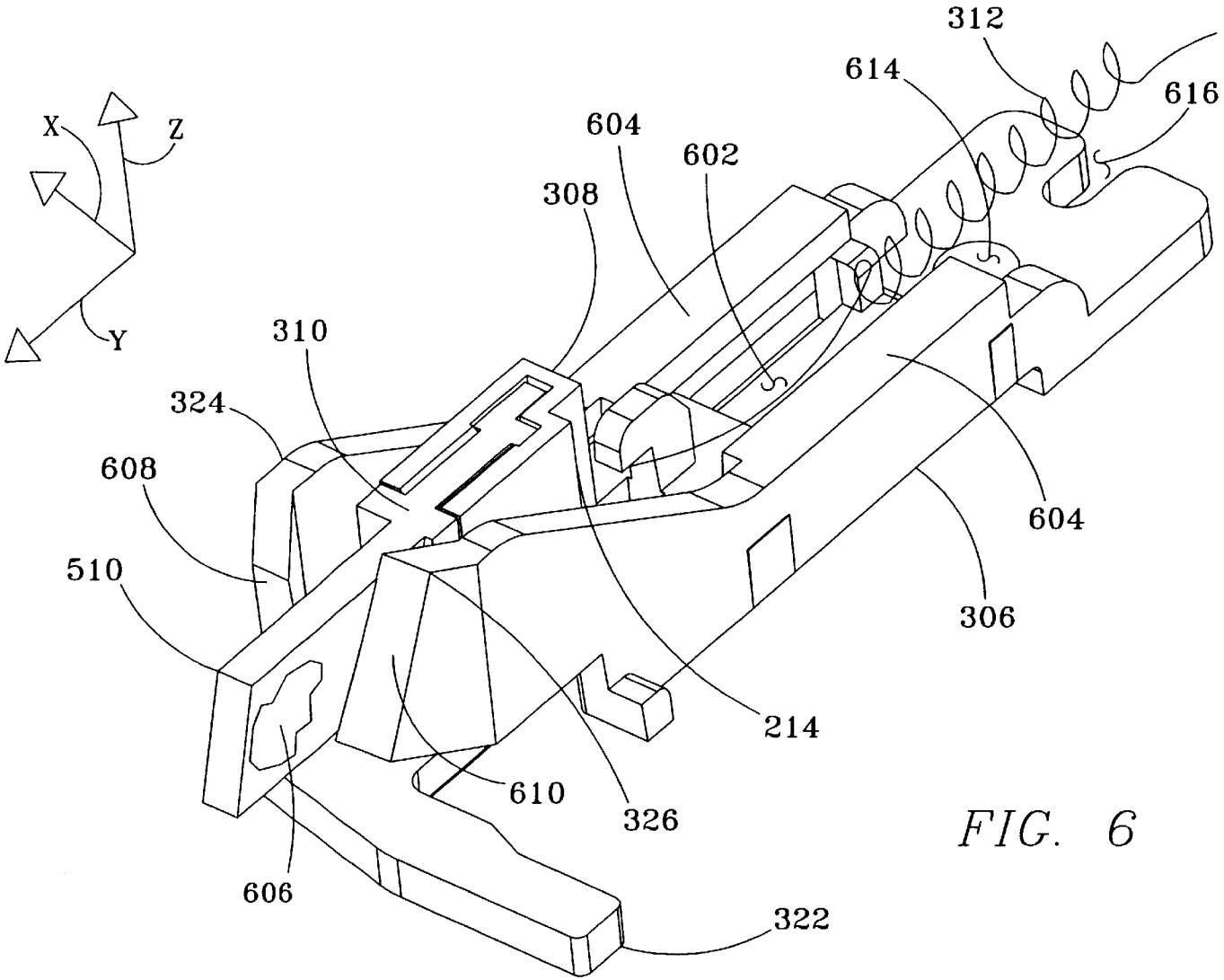
FIG. 6 is an enlarged perspective view of the snout wiper assembly, including the shuttle base, shuttle and the snout wiper, with the shuttle in the wiping position.

FIG. 6 shows an enlarged view of the snout wiper assembly 214, with the shuttle 308 and the snout wiper 310 in the extended position with respect to the shuttle base 306, i.e. the shuttle 308 and snout wiper 310 are extended from the shuttle base 306, thereby allowing contact between the blade 510 of the snout wiper 310 and the snout surface 210 of the pen. Accordingly, the spring 312 is in an elongated condition. A travel slot 602 is defined within the shuttle base 306 between the rails 604, which are spaced to allow travel of the shuttle base 306 between an extended wiping position and a retracted resting position.

The snout wiper 310 moves between the inside and outside blade cleaning members 324, 326. When the snout wiper 310 is moved from the extended position to the retracted position, the blade cleaning arms sweep very close to both planar surfaces of the wiper blade 510, thereby removing ink residue 606 that has built-up on the wiper blade 510. Therefore, ink residue, ink globules and waste are removed from the blade 510 of the snout wiper 310 as it is within drawn into the shuttle base 306. In particular, cleaning surfaces, defined by an edge 608 of the inside cleaning member 324 and an edge 610 of the outside cleaning member 326, are separated by a distance incrementally greater than the thickness of the blade 510 of the snout wiper 310. In general, the cleaning members 324, 326 to not make direct contact with the wiper blade 510, thereby preventing friction that might overcome the bias of the spring 312 urging the shuttle 308 into the shuttle base 306. However, the cleaning members 324, 326 prevent the build-up of ink globules of excessive size, thereby maintaining the blade 510 of the snout wiper 310 in a clean and operable state.

A fastener passing through a hole 614 defined in the shuttle base 306 provides a connection between the shuttle base 306 and the service station 212. An alignment notch 616, defined in the shuttle base 306, allows an alignment post to secure the shuttle base 306 to the service station 212 with a desired orientation.

Figure 7:
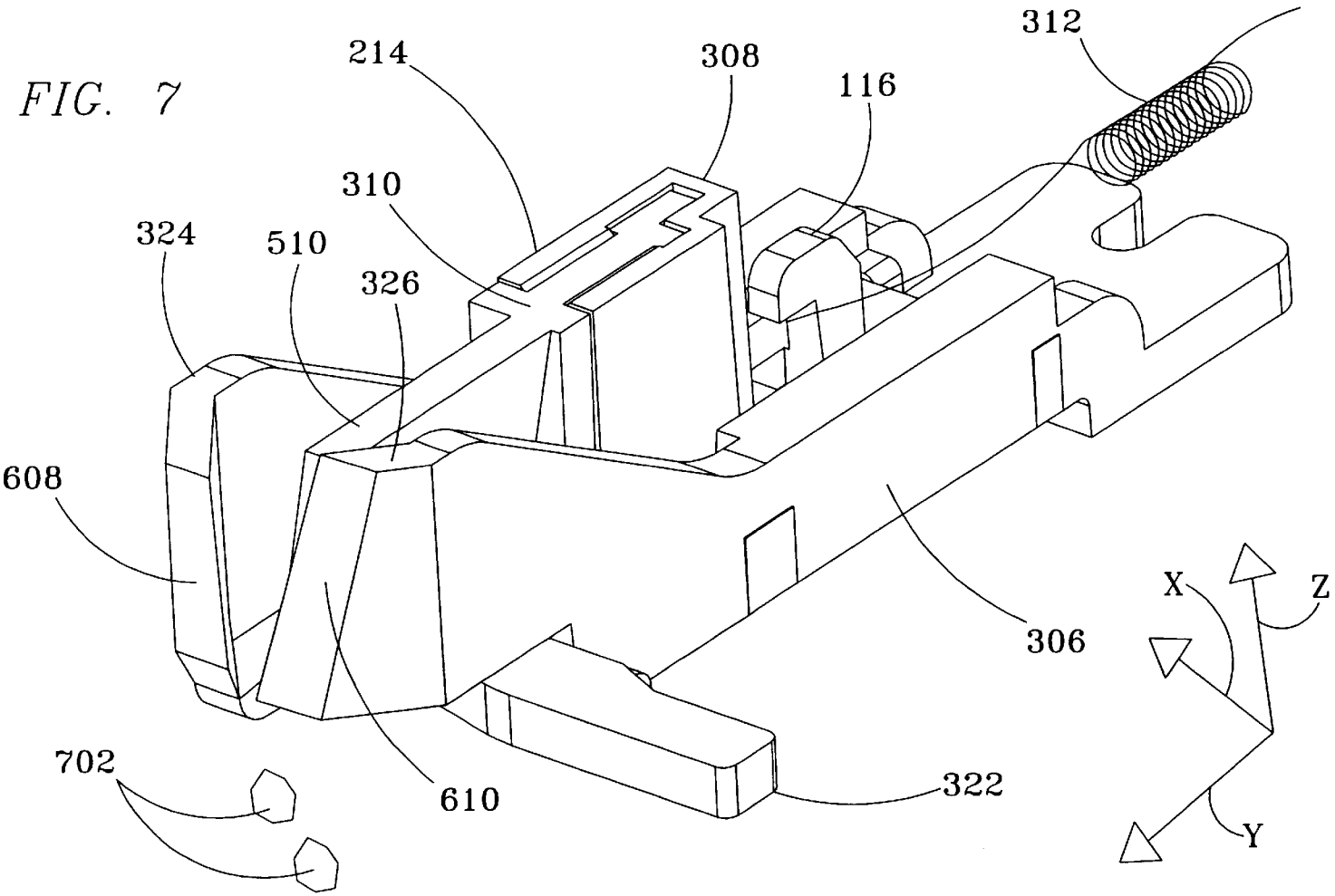
FIG. 7 is an enlarged perspective view of the snout wiper assembly, including the shuttle base, shuttle and the snout wiper, with the shuttle in the resting position.

FIG. 7 shows an enlarged view of the snout wiper assembly 214, with the shuttle 308 and the snout wiper 310 in the retracted position with respect to the shuttle base 306. That is, the arm 322 of the shuttle 308 has been released, and the shuttle 308 and snout wiper 310 have been allowed to retract into the shuttle base 306, thereby preventing contact between the snout wiper 310 and the snout surface 210 of the pen. Accordingly, the spring 312 is in the relaxed state. In particular, the blade 510 of the snout wiper 310 portion of the snout wiper assembly 214 is retracted between inside and outside cleaning members 324, 326 of the shuttle base 306.

The retraction of the blade 510 between the blade cleaning members 324, 326 results in removal of the ink residue 606, previously seen in FIG. 6. The ink residue is removed by contact with inside and outside cleaning edges 608, 610. Following removal, the removed ink residue 702 falls onto the perimeter edge of the spit wheel 304. Rotation of the spit wheel 304 disposes of the removed ink residue.

Figure 8:
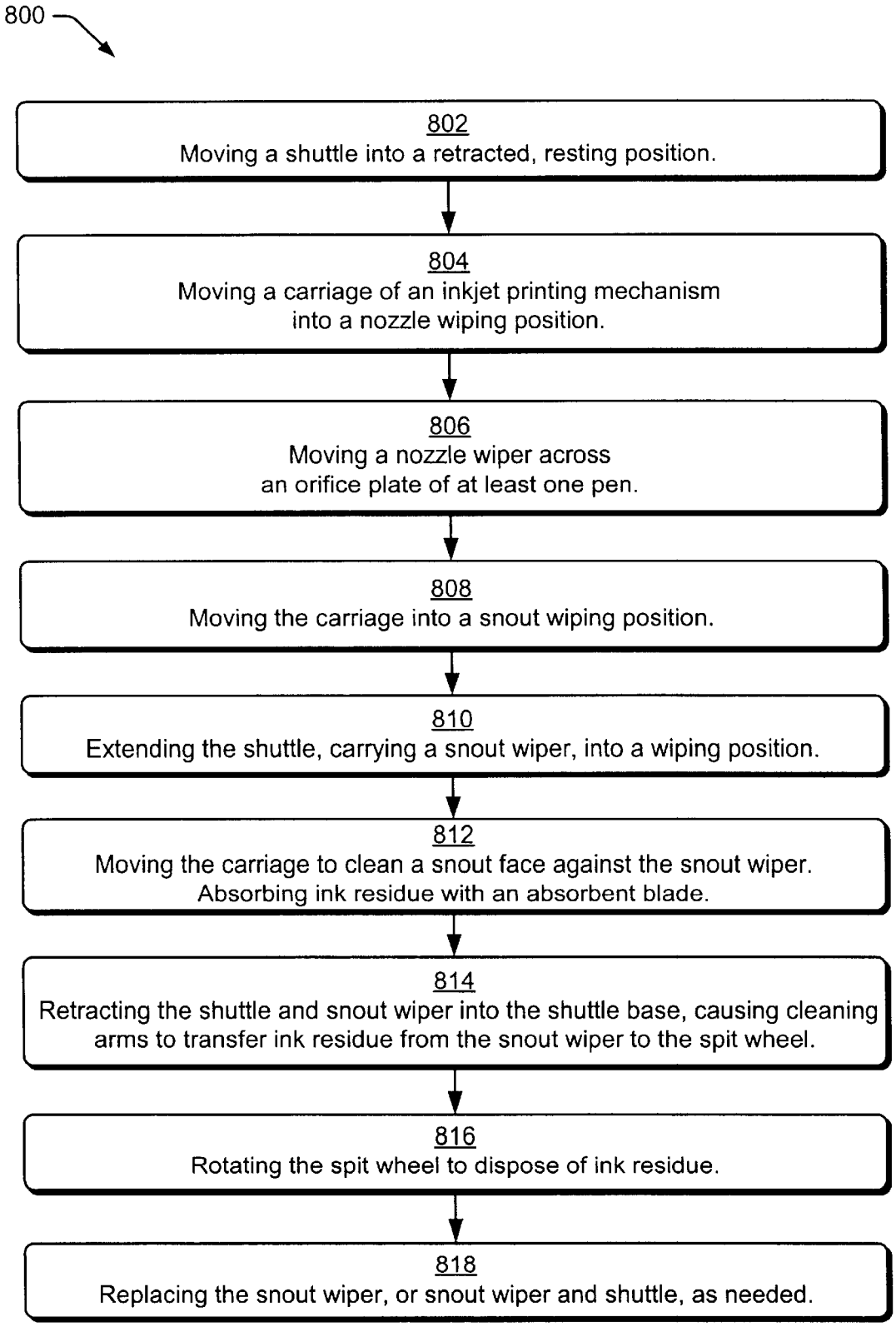
FIG. 8 is a flow chart illustrating an implementation of a method by which the snout wiper assembly may be operated.

The flow chart of FIG. 8 illustrates a method 800 by which the snout surface 210 of a pen or similar inkjet print mechanism may be maintained in a clean and serviceable state. The method may be performed by any desired means, such as by the execution of processor-readable instructions defined on a processor-readable media, such as a disk, a ROM or other memory device. At block 802, the shuttle 308 is moved into a retracted, resting position. The shuttle 308 may be biased into the retracted position, so that the bias must be overcome when extending the shuttle 308. Alternatively, the shuttle 308 may be biased into the extended position, and the bias overcome when retracting the shuttle 308. In a further alternative, the shuttle 308 is not biased in either direction, but is actively moved between the extended and retracted positions.

At block 804, a carriage 202 is moved into a nozzle wiping position within a service station 212. In a typical application, the service station 212 is located within an enclosure of the inkjet printing mechanism, and the carriage 202, carrying one or more (black and color) pens, is moved along a carriage rod to the nozzle wiping position.

At block 806, a nozzle wiper is moved across a nozzle orifice plate 208 of each pen. This action cleans the orifice plate of debris, including partially dried ink residue, ink globules and other material. This cleaning process will move ink globules onto a snout surface 210, adjacent and perpendicular to the nozzle orifice plate 208 in which the nozzles are located.

At block 808, the carriage 202 is moved into a snout wiping position, within or adjacent to, the service station 212.

At block 810, the shuttle carrying a snout wiper 310 is extended from the shuttle base 306 into a wiping position. In the wiping position, the blade portion of the snout wiper 310 is within reach of the snout surface 210 of the pen. The extension may be in response to movement of the nozzle wiper cleaning the nozzle orifice plate 208, and may be against a bias that urges the shuttle 308 into the retracted position within the shuttle base 306.

At block 812, the carriage 202 is moved to clean the snout surface 210 of the pen against the blade portion of the snout wiper 310. By holding the snout wiper 310 in a fixed location, movement of the carriage 202 sweeps the snout surface 210 of the pen with the snout wiper 310.

Where an absorbent blade is employed, as discussed with reference to one of the implementations of FIG. 5, ink residue may be absorbed by the absorbent blade.

At block 814, the shuttle carries the snout wiper 310 back into the retracted position within the shuttle base 306. During this movement, blade cleaning arms remove ink residue and waste carried by the blade portion of the snout wiper 310. The removed ink residue and waste is allowed to fall to a location on a perimeter of a spit wheel 304.

At block 816, the spit wheel 304 is rotated, thereby disposing of the ink residue which may be stored within a waste container.

At block 818, as indicated by failure, or if suggested by a maintenance schedule, elements of the snout wiper 310 assembly may be replaced. In particular, the snout wiper 310 may be replaced by positioning a new snout wiper 310 into the socket defined within the shuttle 308. Alternatively, the shuttle 308 and snout wiper 310 may be replaced as a set. In a still further alternative, the shuttle base 306, shuttle 308 and snout wiper 310 may be replaced as a set.

In conclusion, a snout wiper 310 cleans a snout surface 210 of black and/or color pens within an inkjet printing mechanism, and thereby prevents build up of ink residue, globules and fibers. An implementation of the snout wiper assembly 214 may include a shuttle 308, which is movable along a travel slot defined in a shuttle base 306, between a wiping position and a resting position. The shuttle 308 carries a snout wiper 310, a blade portion of which removes ink deposited on the snout surface 210 of a pen when the shuttle 308 is in the wiping position and the pen is moved against the snout wiper 310. At least one blade cleaning member, carried by the shuttle base 306, includes a surface to clean the blade portion of the snout wiper 310. As the shuttle 308 is moved into the resting position, the blade cleaning members 324, 326 separate ink residue from the blade portion of the snout wiper 310. The ink residue may be dropped by gravity-feed from the blade cleaning member

324, 326 onto the perimeter of a spit wheel 304. Rotation of the spit wheel 304 deposits the waste into a container.

Although the disclosure has been described in language specific to structural features and/or methodological steps, it is to be understood that the appended claims are not limited to the specific features or steps described. Rather, the specific features and steps are exemplary forms of implementing this disclosure. For example, while a spring 312 has been used to bias the shuttle 308 into the retracted position, another biasing means could be substituted. Similarly, while the shuttle 308 is biased into the retracted position, and urged into the extended position, the reverse could be implemented where appropriate.

What is claimed is:

1. An inkjet printing mechanism, comprising:

an inkjet pen having a snout surface;

a snout wiper assembly to clean the snout surface, comprising:

a shuttle base, defining a travel slot;

a shuttle, movable along the travel slot between a wiping position and a resting position; and a snout wiper, carried by the shuttle:

a pair of blade cleaning members, carried by a support member and having a cleaning surface separated incrementally from a blade portion of the snout wiper, to separate ink residue from the blade portion as the supported member is moved from the wiping position to the resting position; and a spit wheel, positioned to receive and remove the ink residue separated from the blade portion of the snout wiper.

2. The inkjet printing mechanism of claims 1, wherein the shuttle base is supported by a service station portion of the inkjet printing mechanism.

3. The inkjet printing mechanism of claim 1, additionally comprising:

a member which biases the shuttle into a first position selected from among; the resting position and the wiping position; and an activation member which moves the shuttle from the first position.

4. The inkjet printing mechanism of claim 1, additionally comprising:

a spring which biases the shuttle into the resting position; and an arm, extending from the shuttle, configured to engage a member extending from a moveable pallet portion of a service station of the inkjet printing mechanism and to move the shuttle from the resting position.

5. The inkjet printing mechanism of claim 1, wherein a blade portion of the snout wiper is configured to absorb ink residue.

6. An inkjet printing mechanism, comprising:

an inkjet pen having a snout surface; and a snout wiper assembly to clean the snout surface, comprising:

a shuttle base, defining a travel slot, wherein the shuttle base is supported by a service station portion of the inkjet printing mechanism and wherein the shuttle base defines an alignment notch to orient the shuttle base with respect to the inkjet printing mechanism;

a shuttle, movable along the travel slot between a wiping position and a resting position, wherein the shuttle defines a socket within which a base portion of a snout wiper is carried;

a pair of blade cleaning members, each blade cleaning member carried by the shuttle base and having a cleaning surface separated incrementally from a blade portion of the snout wiper, to separate ink residue from the blade portion as the shuttle is moved from the wiping to the resting position;

a member which biases the shuttle into a first position, the first position selected from among: the resting position and the wiping position;

an activation member which urges the shuttle from the first position; and a spit wheel, positioned to receive and remove the ink residue separated from the blade portion of the snout wiper by the pair of blade cleaning members.

7. The inkjet printing mechanism of claim 6, wherein the member which biases the shuttle into the first position is a spring which biases the shuttle into the resting position; and wherein the activation member is an arm, extending form the shuttle, configured to engage a member extending from a moveable pallet portion of a service station of the inkjet printing mechanism, and configured to move the shuttle into the wiping position.

8. A method of servicing an inkjet printing mechanism, comprising:

moving an inkjet pen into a nozzle wiping position;

wiping an orifice plate of the inkjet pen;

depositing some residue removed from the orifice plate onto a snout surface of the inkjet pen;

moving the inkjet pen into a snout wiping position;

moving a shuttle into a wiping position;

moving the inkjet pen to transfer the residue from the snout surface to a blade portion of a snout wiper carried by the shuttle; and moving the shuttle into a resting position, thereby moving the blade portion of the snout wiper between two blade cleaning members, which contact and remove the residue from the blade portion.

9. The method of claim 8, wherein moving the shuttle into the wiping position comprises overcoming a bias which urges the shuttle into the resting position.

10. The method of claim 8, wherein moving the shuttle into the resting position comprises urging the shuttle with a biasing member.

11. The method of claim 8, additionally comprising:

absorbing ink residue with an absorbent blade.

12. The method of claim 8, additionally comprising:

transporting residue that falls off the two blade cleaning members with a spit wheel.

13. A processor-readable medium comprising processor-executable instructions for:

moving an inkjet pen into a nozzle wiping position;

wiping an orifice plate of the inkjet pen;

depositing some residue removed from the orifice plate onto the snout surface;

moving the inkjet pen into a snout wiping position;

moving a shuttle into a wiping position;

moving the inkjet pen to transfer the residue from the snout surface to a blade portion of a snout wiper carried by the shuttle; and moving the shuttle into a resting position, thereby moving the blade portion of the snout wiper between two blade cleaning members, which contact and remove the residue from the blade portion.

14. A processor-readable medium as recited in claim 13, comprising further instructions for overcoming a bias, when moving the shuttle into the wiping position, which urges the shuttle into the resting position.

15. A processor-readable medium as recited in claim 13, comprising further instructions for moving the shuttle by allowing a biasing member to urge the shuttle into the resting position.

16. A processor-readable medium as recited in claim 13, comprising further instructions for removing residue that falls off the two blade cleaning members by controlling rotation of a spit wheel.

17. A processor-readable medium comprising processor-executable instructions for:

moving an inkjet pen into a nozzle wiping position;

wiping an orifice plate of the inkjet pen;

depositing residue removed from the orifice plate onto a snout surface;

moving the inkjet pen into a snout wiping position;

moving a shuttle into a wiping position by overcoming a bias which urges the shuttle into a resting position;

moving the inkjet pen to transfer the residue from the snout surface to a blade portion of a snout wiper carried by the shuttle;

moving the shuttle into the resting position by urging the shuttle with a biasing member, thereby moving the blade portion of the snout wiper between two blade cleaning members that remove the residue from the blade portion; and removing residue that falls off the two blade cleaning members with a spit wheel.

18. An inkjet printing mechanism, comprising:

means for moving an inkjet pen into a nozzle wiping position;

means for wiping an orifice plate of the inkjet pen;

means for depositing residue removed from the orifice plate onto a snout surface of the inkjet pen;

means for moving the inkjet pen into a snout wiping position;

means for moving a shuttle into a wiping position;

means for moving the inkjet pen to transfer the residue from the snout surface to a blade portion of a snout wiper carried by the shuttle; and means for moving the blade portion of the snout wiper between two blade cleaning members, which remove the residue from the blade portion.

19. The inkjet printing mechanism of claim 18, wherein means for moving the shuttle into the wiping position comprises means for overcoming a bias which urges the shuttle into a resting position.

20. The inlet printing mechanism of claim 18, wherein means for moving the blade portion of the snout wiper between the two blade cleaning members comprises means for urging the shuttle with a biasing member.

21. The inkjet printing mechanism of claim 18, additionally comprising:

means for absorbing residue with the blade portion of the snout wiper.

* * * * *

UNITED STATES PATENT AND TRADEMARK OFFICE

CERTIFICATE OF CORRECTION

PATENT NO. : 6,644,776 B1
DATED : November 11, 2003
INVENTOR(S) : Barinaga et al.

It is certified that error appears in the above-identified patent and that said Letters Patent is hereby corrected as shown below:

Column 8,
Line 19, delete “form” and insert in lieu thereof -- from --.

Signed and Sealed this

Nineteenth Day of October, 2004

JON W. DUDAS
*Director of the United States Patent and Trademark Office*